US006932936B2

(12) United States Patent
Ezure

(10) Patent No.: US 6,932,936 B2
(45) Date of Patent: Aug. 23, 2005

(54) MANUFACTURING METHOD FOR DOUBLE TUBE HAVING A HOLE FORMED THEREIN, AND MOLD FOR IMPLEMENTATION THEREOF

(75) Inventor: Kazuhiro Ezure, Koga (JP)

(73) Assignees: Sanoh Industries Co., Ltd., Ibaraki (JP); Sumitomo Metal Industries, Ltd., Osaka (JP); Sumitomo Pipe & Tube Co., Ltd., Ibaraki (JP)

( * ) Notice: Subject to any disclaimer, the term of this patent is extended or adjusted under 35 U.S.C. 154(b) by 378 days.

(21) Appl. No.: 10/246,687

(22) Filed: Sep. 19, 2002

(65) Prior Publication Data

US 2003/0080460 A1 May 1, 2003

(30) Foreign Application Priority Data

Oct. 30, 2001 (JP) ..... 2001-332997

(51) Int. Cl.[7] ..... B26F 1/26; B26F 1/04; B26D 3/08; B26D 7/27

(52) U.S. Cl. ..... 264/504; 264/570; 264/154; 264/155; 264/284; 264/293; 425/290; 425/291; 83/53; 83/879; 83/880

(58) Field of Search ..... 264/504, 570, 264/284, 293, 154, 155; 425/290, 291; 83/53, 879, 880

(56) References Cited

U.S. PATENT DOCUMENTS 1,409,154 A * 3/1922 Davis ..... 264/504
3,560,601 A * 2/1971 Johnson et al. ..... 264/504
4,341,727 A * 7/1982 Landsness et al. ..... 264/145
4,873,048 A * 10/1989 Jarvenkyla ..... 264/504
5,405,569 A * 4/1995 Lupke ..... 264/504
5,897,828 A * 4/1999 Sillince et al. ..... 264/504
6,066,287 A * 5/2000 Brady et al. ..... 264/513
6,375,891 B1 * 4/2002 Nishikawa et al. ..... 264/534
6,468,453 B1 * 10/2002 Gaidjiergis et al. ..... 264/156
6,706,236 B2 * 3/2004 Zaremba et al. ..... 264/504

* cited by examiner

*Primary Examiner*—Michael P. Colaianni
*Assistant Examiner*—Michael I. Poe
(74) *Attorney, Agent, or Firm*—Varndell & Varndell, PLLC

(57) ABSTRACT

To provide manufacturing method for a double tube having a hole formed therein and a mold for implementing such method, which reduce the time required for manufacturing, do not leave shavings in the gap between the outer tube and the inner tube, and offer highly accurate hole positioning. The manufacturing method for a double tube having a hole formed therein pertaining to the present invention uses a mold in which a punch is located in at least one of the split mold halves that form the outer circumferential surface, an indentation is formed by drawing the punch into the mold, and fluid pressure is applied between the outer tube and the inner tube of the double tube located within the mold to form a hole in the circumferential wall of the outer tube via such indentation. Furthermore, the punch is placed in the mold in a watertight fashion.

8 Claims, 3 Drawing Sheets

MANUFACTURING METHOD FOR DOUBLE TUBE HAVING A HOLE FORMED THEREIN, AND MOLD FOR IMPLEMENTATION THEREOF

BACKGROUND OF THE INVENTION

1. Field of the Invention

The present invention relates to a manufacturing method for a double tube having a hole formed therein, as well as to a mold for implementing such method.

2. Description of the Related Art

Examples of a double pipe having a hole formed therein include an EGR (exhaust gas recirculation) cooling pipe, which has a construction in which a hole is formed in the outer tube of a double tube having an appropriate gap between the outer tube and the inner tube, coolant liquid is introduced into such gap via the hole, and the exhaust gas circulating inside the interior of the inner tube is cooled by this coolant liquid.

Incidentally, in the double tube having a hole formed therein described above, after the double tube 1 is formed by inserting the inner tube 1*b* inside the outer tube 1*a*, a hole 3 is formed in the outer tube 1*a* using a drill 2 or the like, as shown in FIG. 3(*a*). However, when this type of method for forming the hole 3 is used, as shown in FIG. 3(*b*), shavings 4 remain inside the gap 5 between the outer tube 1*a* and the inner tube 1*b*. In order to remove these shavings 4, air is blown into the gap 5 between the outer tube 1*a* and the inner tube 1*b*, and this blown air expels the shavings 4 from the gap 5.

Therefore, where this type of method for forming the hole 3 is used, not only is it troublesome to carry out the drilling using the drill 2, but it is also labor-intensive and time-consuming to remove the shavings 4, which are furthermore difficult to completely remove.

SUMMARY OF THE INVENTION

Accordingly, an object of the present invention is to provide a manufacturing method for a double tube having a hole formed therein in which the amount of time required to form the hole is reduced, no shavings or other debris remain in the gap between the outer tube and the inner tube, and the hole is positioned with high accuracy, as well as to a mold for implementing such method.

In the manufacturing method for a double tube having a hole formed therein according to the present invention, a mold is used in which a punch is located in at least one of the split mold halves that form the outer circumferential surface, an indentation is formed by drawing this punch into the mold, and fluid pressure is applied between the outer tube and the inner tube of the double tube located within the mold to form a hole in the circumferential wall of the outer tube via such indentation.

According to the method of the present invention, a hole is formed in the outer tube using the so-called hydroforming process.

Therefore, because shavings do not enter the space between the outer tube and the inner tube as they do when the hole is formed using a drill, the difficult process of removing such shavings need no longer be performed, and there is absolutely no risk of shavings remaining between the outer tube and the inner tube, and consequently a highly reliable product may be obtained.

In the hole formation process of the method described above, where a hole is formed in the outer tube, an indentation may be formed by drawing the punch into the mold either before fluid pressure is applied between the outer tube and the inner tube (claim 2) or after fluid pressure is applied between the outer tube and the inner tube (claim 3).

It is furthermore acceptable if the punch is caused to protrude into the mold by an amount less than the thickness of the circumferential wall of the outer tube and subsequently the punch is drawn into the mold to form a hole in the circumferential wall of the outer tube (claim 4).

Using this method, because during the hole opening process only a part of the thickness of the outer tube is cut out due to the protrusion of the punch into the circumferential wall of the outer tube and a hole is then punched out as a result of fluid pressure, in a manner identical to that used in hydroforming, the hole opening process can be carried out using a relatively low level of fluid pressure, and the hole can be formed without the occurrence of shear drop.

Moreover, using this double tube manufacturing method, when the hole is formed in the outer tube via fluid pressure in the same manner as that used in the hydroforming process, the outer tube can be caused to expand in diameter by the fluid pressure (claim 5).

In addition, when employing the mold used in the manufacturing method for a double tube having a hole formed therein described in claim 6 pertaining to the present invention, the punch is placed in a watertight fashion.

Using this type of mold, because the interior of the mold is kept watertight, there is no reduction in the fluid pressure operating between the outer tube and the inner tube even when a hole is formed in the outer tube. Consequently, the use of this type of mold is particularly essential when a plurality of holes are to be formed in the outer tube.

DESCRIPTION OF THE PREFERRED EMBODIMENTS

The manufacturing method for a double tube having a hole formed therein pertaining to the present invention and the mold used to implement such method will be described below with reference to the drawings.

Figure 1A:
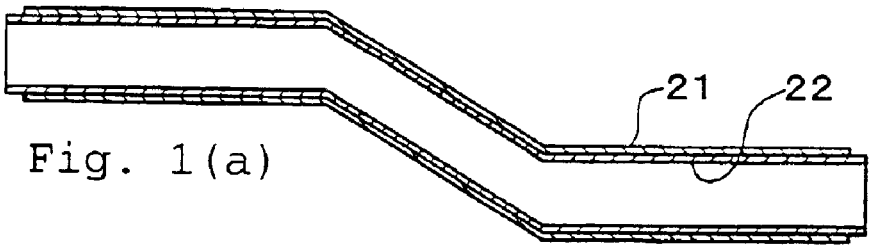
FIG. 1 shows the manufacturing method for a double tube having a hole formed therein pertaining to the present invention, and FIGS. 1(*a*), 1(*b*) and 1(*c*) are conceptual cross-sections showing the sequence of such method.
Figure 1B:
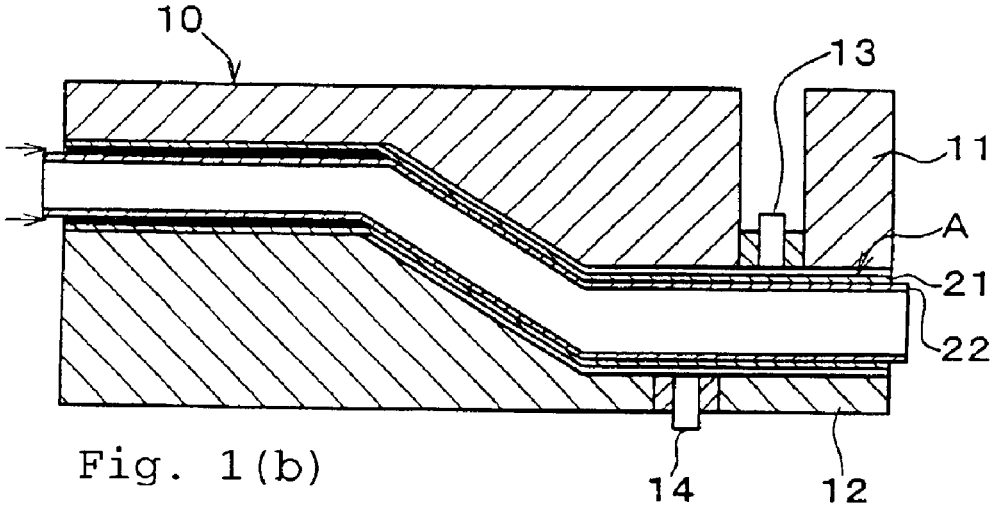
Figure 1C:
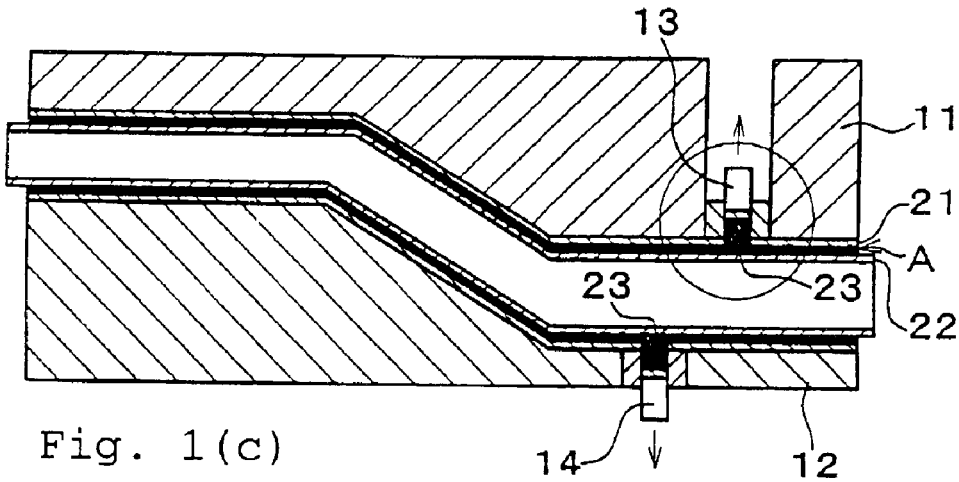
Figure 2:
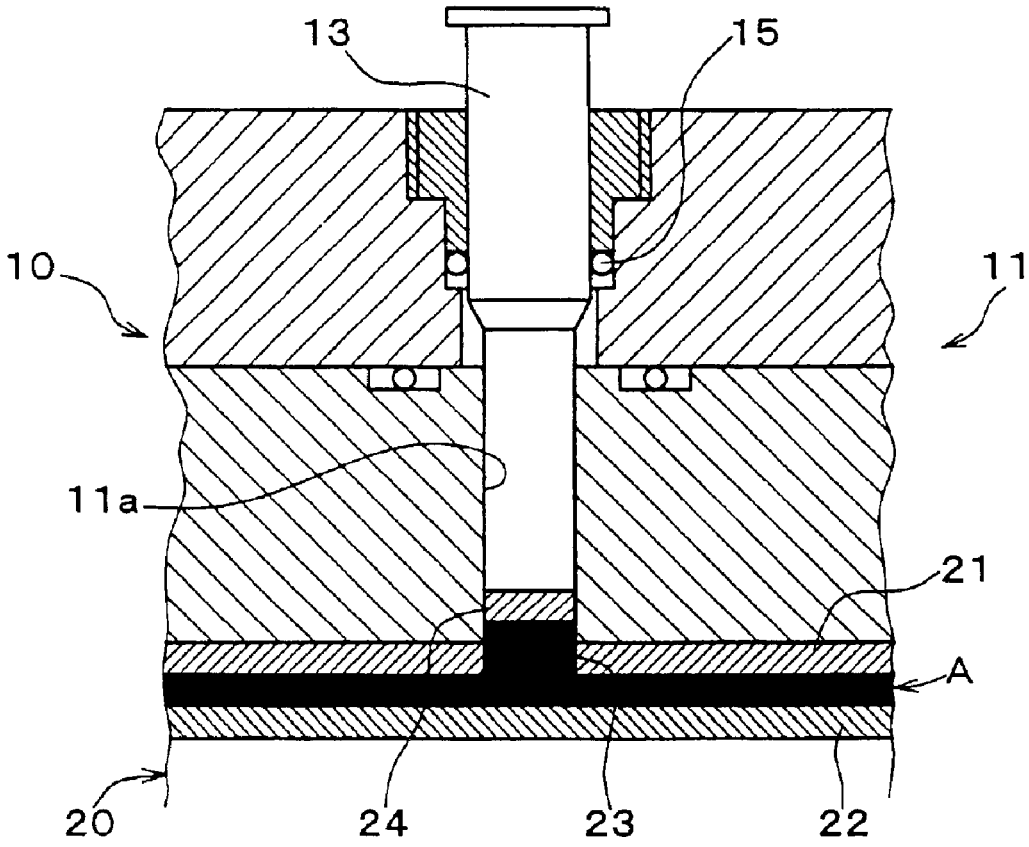
FIG. 2 is a cross-section showing the key components of the punch seal mechanism of the mold shown in FIG. 1.
Figure 3A:
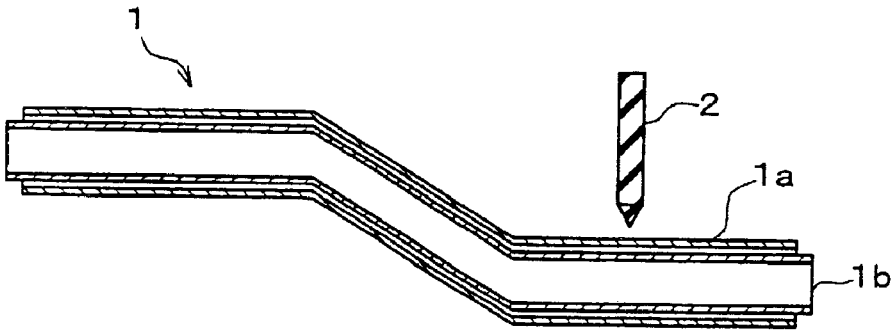
Fig. 3(a) PRIOR ART
FIG. 3 shows the conventional hole opening process for a double tube having a hole formed therein, wherein FIG. 3(*a*) is a conceptual cross-section showing the state prior to hole opening, and FIG. 3(*b*) is an enlarged conceptual cross-section showing the state after hole opening.
Figure 3B:
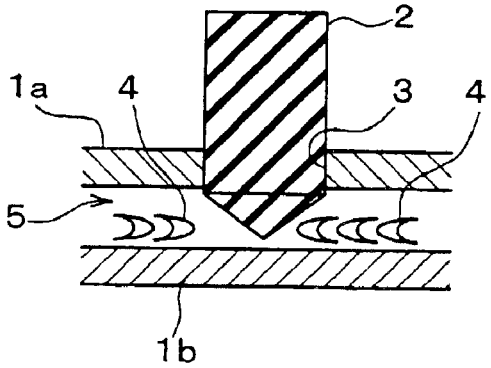
Fig. 3(b) PRIOR ART

FIG. 1 is a conceptual cross-section showing the sequence of the manufacturing method for a double tube having a hole formed therein pertaining to the present invention, and FIG. 2 is a cross-section showing the key components of the mold used in such method.

As shown in FIG. 1, the mold 10 of the present invention comprises a top mold half 11 and a bottom mold half 12, and punches 13 and 14 are located in the top mold half 11 and the bottom mold half 12, respectively. The punches 13 and 14 have a packing 15 comprising an O-ring or the like located in the punch pass-through hole 11*a* formed in the top mold half 11, and this packing 15 creates a watertight seal between the punch 13 and the top mold half 11, as shown in FIG. 2. Furthermore, while it is not shown in the drawings, an identical watertight seal also exists between the punch 14 and the bottom mold half 12.

In the manufacturing method for the double tube 20 having a hole formed therein pertaining to the present invention, as shown in FIG. 1(*a*), an inner tube 22 is first inserted inside an outer tube 21, and subsequently both the outer tube 21 and the inner tube 22 simultaneously undergo bending. In this state, there is an approximately 0.5 mm gap between the outer tube 21 and the inner tube 22. Next, the outer tube 21 and the inner tube 22 are aligned with each other and their ends are welded at appropriate locations along their circumference.

The double tube 20 formed in this manner is then placed inside the mold 10 as shown in FIG. 1(*b*), fluid pressure is applied in the space (the gap A) between the outer tube 21 and the inner tube 22, and inside the inner tube 22, and the diameter of the outer tube 21 is expanded via so-called hydroforming. Next, the punches 13 and 14 are drawn into the top mold half 11 and the bottom mold half 12, respectively. When this is done, holes 23 are formed in the outer tube 21 via the fluid pressure operating between the outer tube 21 and the inner tube 22, as shown in FIG. 1(*c*).

The double tube 20 is then extracted from the mold 10 and the ends of the outer tube 21 and the inner tube 22 are welded together around their entire circumference while the gap A therebetween is maintained at an appropriate distance, thereby forming a coolant jacket between the outer tube 21 and the inner tube 22.

When hole formation in the outer tube 21 is completed, debris 24 remains inside the punch pass-through hole 11*a* of the mold 10, but it can be expelled from the punch pass-through holes by causing the punches 13 and 14 to protrude completely from the mold 10.

Furthermore, in the above embodiment, when holes are formed in the outer tube 21, the punches 13 and 14 are respectively drawn into the top mold half 11 and the bottom mold half 12 after fluid pressure is applied in the space (the gap A) between the outer tube 21 and the inner tube 22, but it is also acceptable if the punches 13 and 14 are respectively drawn into the top mold half 11 and bottom mold half 12 before fluid pressure is applied in the gap A. It is alternatively acceptable to cut out portions of the outer tube 21 by causing the punches 13 and 14 to protrude into the gap A by a small amount (such as by an amount equal to half of the thickness of the outer tube 21), and thereafter draw the punches 13 and 14 into the top mold 11 and the bottom mold 12.

Moreover, in the above embodiment, the holes 23 are formed either during or after diameter expansion of the outer tube 21, but it is naturally possible to merely form the holes 23 in the outer tube 21 without expanding the outer tube 21.

In addition, in the above embodiment, an example was described in which the holes 23 were formed in a bent double tube 20, but the method of the present invention is not limited to a bent double tube, and can naturally be applied to a straight tube.

Where a hole is formed in a bent double tube using a drill or the like, the tube must be positioned using a jig or the like, but when using the method of the present invention, no jig or similar device is necessary.

Using the manufacturing method for a double tube having a hole formed therein pertaining to the present invention, a hole is formed in the outer tube using a method identical to so-called hydroforming.

Therefore, because shavings do not enter the space between the outer tube and the inner tube as they do when the hole is formed using a drill, the difficult process of removing such shavings need no longer be performed, and there is absolutely no risk of shavings remaining between the outer tube and the inner tube, thereby a highly reliable product can be obtained.

In addition, where the present invention is applied to a bent, i.e., deformed, double tube, in comparison with the conventional art in which a hole is formed using a drill or the like, a jig or similar device is not needed for the purpose of positioning of the tube, and work related thereto need not be performed. This makes the hole formation process easier to perform, and increases the accuracy of hole placement.

Moreover, because the interior of the mold used for manufacturing the double tube having a hole formed therein pertaining to the present invention is kept in a watertight state, there is no reduction in the fluid pressure operating between the outer tube and the inner tube even when a hole is formed in the outer tube. Consequently, the use of this type of mold is particularly useful when a plurality of holes are to be formed in the outer tube.

What is claimed is:

1. A manufacturing method for a double tube having inner and outer tubes with a hole formed in the outer tube, which comprises:

forming the double tube;

placing the formed double tube into a mold having two split mold halves, where a punch is located in at least one of the split mold halves that form an outer circumferential surface of the mold;

forming an indentation by drawing said punch into said mold;

applying fluid pressure between the outer tube and the inner tube of the double tube located within the mold, and forming the hole in the circumferential wall of said outer tube by means of such indentation.

2. The manufacturing method for a double tube having a hole formed therein according to claim 1, wherein said outer tube is caused to expand in diameter by said fluid pressure.

3. A manufacturing method for a double tube having a hole formed therein, wherein such method uses a mold in which a punch is located in at least one of the split mold halves that form an outer circumferential surface of the mold, an indentation is formed by drawing said punch into said mold, fluid pressure is applied between the outer tube and the inner tube of the double tube located within the mold, and a hole is formed in the circumferential wall of said outer tube by means of such indentation, and said indentation is formed before said fluid pressure is applied between said outer tube and said inner tube.

4. The manufacturing method for a double tube having a hole formed therein according to claim 3, wherein said outer tube is caused to expand in diameter by said fluid pressure.

5. A manufacturing method for double tube having inner and outer tubes with a hole formed in the outer tube, which comprises:

forming the double tube;

placing the formed double tube into a mold having two split mold halves, where a punch is located in at least one of the split mold halves that form an outer circumferential surface of the mold;

applying fluid pressure between the outer tube and the inner tube of the double tube located within the mold; and forming the hole by means of an indentation after said fluid pressure is applied between said outer tube and said inner tube.

6. The manufacturing method for a double tube having a hole formed therein according to claim 5, wherein said outer tube is caused to expand in diameter by said fluid pressure.

7. The manufacturing method for double tube having a hole formed therein according to claim 5, wherein said indentation is formed by a punch protruding into said mold by an amount less than the thickness of the circumferential wall of the said outer tube, and then a hole is formed in the circumferential wall of said outer tube by drawing said punch into said mold.

8. The manufacturing method for a double tube having a hole formed therein according to claim 7, wherein said outer tube is caused to expand in diameter by said fluid pressure.

* * * * *